US006991118B2

(12) United States Patent
Phillips

(10) Patent No.: US 6,991,118 B2
(45) Date of Patent: Jan. 31, 2006

(54) ACCESSORY HOLDING DEVICE

(76) Inventor: Brenda Phillips, 104 Rosewood Pl., Carey, OH (US) 43316

( * ) Notice: Subject to any disclaimer, the term of this patent is extended or adjusted under 35 U.S.C. 154(b) by 21 days.

(21) Appl. No.: 10/374,230

(22) Filed: Feb. 25, 2003

(65) Prior Publication Data

US 2004/0164037 A1 Aug. 26, 2004

(51) Int. Cl.
*A47G 29/00* (2006.01)
*A47F 7/19* (2006.01)

(52) U.S. Cl. ..... 211/85.3; 211/85.2; 211/49.1

(58) Field of Classification Search ..... 211/85.3, 211/85.2, 13.1, 59.1, 49.1; D6/436; 206/6.1, 206/566, 38; D28/73; 312/107
See application file for complete search history.

(56) References Cited

U.S. PATENT DOCUMENTS

| | | | | | |
|---|---|---|---|---|---|
| 715,563 | A | * | 12/1902 | Doublat | 211/1 |
| 1,353,974 | A | * | 9/1920 | Smith | 211/85.3 |
| 2,307,241 | A | * | 1/1943 | Sayre | 294/158 |
| 2,525,259 | A | * | 10/1950 | Fenzl | 211/85.3 |
| 3,421,634 | A | * | 1/1969 | Huth | 211/123 |
| 3,788,487 | A | * | 1/1974 | Dawson | 211/49.1 |
| 3,853,225 | A | * | 12/1974 | Gegauff | 211/85.3 |
| 4,662,519 | A | * | 5/1987 | Ciociola | 206/457 |
| 4,775,053 | A | * | 10/1988 | Geiger | 211/85.2 |
| 4,776,650 | A | * | 10/1988 | Ferenzi | 312/245 |
| 4,978,001 | A | * | 12/1990 | Nelson | 206/748 |
| 5,031,758 | A | | 7/1991 | Gonzalez | |
| 5,087,105 | A | * | 2/1992 | White | 312/245 |
| 5,242,048 | A | * | 9/1993 | Ellingsworth et al. | 206/6.1 |
| 5,244,265 | A | * | 9/1993 | Chiang | 312/107 |
| 5,255,970 | A | * | 10/1993 | Theosabrata | 312/297 |
| 5,427,231 | A | * | 6/1995 | Willimann | 206/38 |
| 5,452,806 | A | | 9/1995 | Campas | |
| 5,511,873 | A | * | 4/1996 | Mech | 312/227 |
| 5,551,772 | A | * | 9/1996 | Keffer | 312/114 |
| 5,626,503 | A | | 5/1997 | Heftel et al. | |
| D387,497 | S | * | 12/1997 | Guiliano | D28/73 |
| 5,931,319 | A | * | 8/1999 | Murphy | 211/85.2 |
| 6,076,685 | A | | 6/2000 | Ramirez | |
| 6,202,851 | B1 | | 3/2001 | Walker | |
| 6,361,130 | B1 | * | 3/2002 | Kardy | 312/245 |

* cited by examiner

*Primary Examiner*—Jennifer E. Novosad
(74) *Attorney, Agent, or Firm*—Gallagher & Dawsey Co., LPA; Michael J. Gallagher; David J. Dawsey

(57) ABSTRACT

An accessory holding device for holding a plurality of accessory devices, such as hair clips, bows, barrettes, ties, and other hair accessories; as well as various items of jewelry. Internal attachment members hold clip type devices, while various posts, suspension devices, flexible attachment members, drawers, and retainers are provided to accommodate a wide array of items. The device may be relatively open, formed only with a base and sides, or may be enclosed with top, back, and face plates, in differing embodiments. The device may be free-standing, and may have suction grips to enhance adhesion to various surfaces. It may also be provided with a mounting device so that the entire device may be hung on the wall, back of door, or other surface. The device may have mirrors on various surfaces and may be fitted with an interior light.

8 Claims, 5 Drawing Sheets

ACCESSORY HOLDING DEVICE

TECHNICAL FIELD

The instant invention relates to accessory holders, particularly, holders designed to hold personal grooming accessories.

BACKGROUND OF THE INVENTION

Personal accessories, such as hair clips, barrettes, annular elastic hair ties, and various items of jewelry are most commonly stored in a drawer or tray, where they are likely to become entangled or mislaid. Additionally, items like hair clips or earrings, which a wearer might use in pairs or as multiple items, become separated from matching items when stored loosely. This requires time consuming searching for the match for a particular item. Also, items such as the above often have sharp projections that can injure a person rifling through a messy drawer, or pose an unseen hazard to the feet when inadvertently dropped to the floor. Small, loose, scattered objects pose a risk to children and pets that may ingest them. As these types of items are frequently stored in bathrooms, the small object may pose retrieval or drain clogging dangers if they fall into a sink or become unhygienically contaminated upon falling onto a bathroom floor or into other appliances.

Various devices have attempted to deal with aspects of these problems, although none as reasonably and effectively as the instant invention. U.S. Pat. No. 5,031,758 to Gonzalez is typical of those devices which utilize a hanging braid type device to hold items. The braid may tend to swing away from the user attempting to mount items, possibly requiring the use of two hands to affix or release items. Additionally, the braid, being of a soft and absorbent material, is inherently more difficult to clean than the instant invention. Elastic items, such as annular elastic hair ties, cannot be easily fastened to a braid, and must be stored, in the '758 device, in bins, thus decreasing the utility of the display feature. Similar problems affect other braid like display devices, such as those of U.S. Pat. No. 6,076,685 and U.S. Pat. No. 5,452,806.

Rigid or semi-rigid accessory holders have different problems, as can be illustrated by U.S. Pat. No. 5,626,503. This single pole accessory holder has a small base and would be top-heavy, making it unsuitable for use as a free standing unit, as it is, in fact, designed to be hung from a hook. Accessories such as hair clips and annular elastic hair ties may be mixed on top of and below other items on the holder, leading to the possibility of knocking various items off of the display when attempting to retrieve others. Additionally, elastic items such as annular elastic hair ties are held in a partially stretched position, such that, over time, storage on such a device lo will tend to fatigue the elastic members upon which these annular ties depend for their functioning.

Accordingly, the art has needed a means for improving the art of accessory storage. While some of the prior art devices attempted to improve the state of the art of accessory storage, none has achieved the unique and novel configurations and capabilities of the present invention. The present invention makes many improvements over the current state of the art. First, the plurality of grippable surfaces makes it easy and convenient to store a wide range of items. Second, paired or multiple items may be easily stored in proximity to each other. The grippable surfaces themselves are easily cleaned. In some embodiments, the accessory holder is enclosed, preventing accumulation of dust upon the stored items. Additionally, the present invention may accommodate widely varying sizes of clips without causing fatigue to the spring and elastic elements. With these capabilities taken into consideration, the instant invention addresses many of the shortcomings of the prior art and offers significant benefits heretofore unavailable. Further, none of the above inventions and patents, taken either singly or in combination, is seen to describe the instant invention as claimed.

SUMMARY OF INVENTION

In its most general configuration, the instant invention is an accessory device holder capable of holding a plurality of accessory devices, such as, by way of example and not limitation, hair clips, bows, barrettes, ties, and other hair accessories; as well as various items of jewelry. A plurality of internal attachment members hold clip type devices, while various posts, suspension devices, flexible attachment members, drawers, and retainers are provided in different embodiments to accommodate a wide array of items.

The device may be relatively open, being formed only with a base and at least one side or it may be more enclosed with the addition of top, back, and face plates, as well as doors, in differing embodiments. The device may be free-standing, and may be supplied with suction grips to enhance adhesion to various surfaces. It may also be provided with a mounting device so that the entire device may be hung on the wall, back of door, or other surface. The device may have mirrors on various front surfaces to make it easier for the user to adjust accessories and appearance, and it may be fitted with an interior light to make it easier to see small items within the device.

BRIEF DESCRIPTION OF THE DRAWINGS

Without limiting the scope of the present invention as claimed below and referring now to the drawings and figures:

Also, in the various figures and drawings, the following reference symbols and letters are used to identify the various elements described herein below in connection with the several figures and illustrations: C, T, N, B.

DETAILED DESCRIPTION OF THE INVENTION

The accessory holder of the instant invention enables a significant advance in the state of the art. The preferred embodiments of the apparatus, seen in FIGS. 1 through 10, accomplish this by new and novel arrangements of elements that are configured in unique and novel ways and which demonstrate previously unavailable but preferred and desirable capabilities.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

These variations, modifications, alternatives, and alterations of the various preferred embodiments, arrangements, and configurations may be used alone or in combination with one another as will become more readily apparent to those with skill in the art with reference to the following detailed description of the preferred embodiments and the accompanying figures and drawings.

Figure 1:
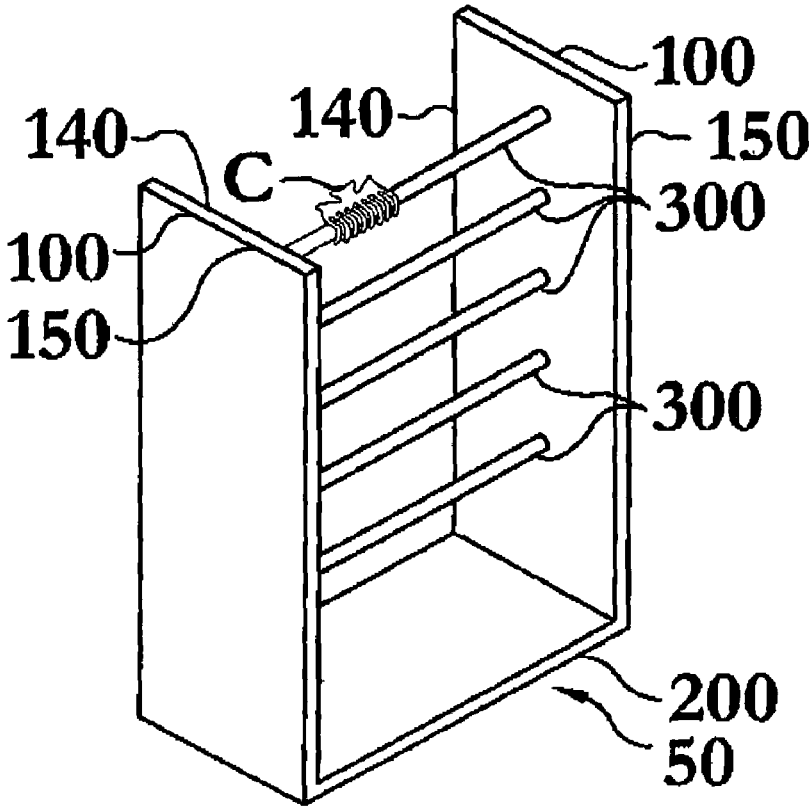
FIG. 1 shows an accessory holding device of the instant invention in elevated perspective view, in reduced scale.
Figure 2:
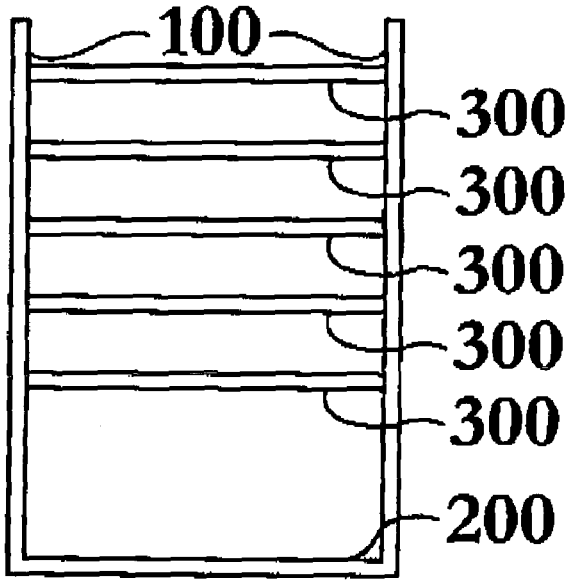
FIG. 2 shows the accessory holding device of FIG. 1, in front elevation view, in reduced scale.

In a basic embodiment, seen in FIGS. 1 and 2, an accessory holding device 50 comprises at least one sidewall 100 having an inner surface 140 and an outer surface 150, and a base plate 200, wherein the base plate 200 is attached to the at least one sidewall 100. There are a plurality of internal attachment members 300, wherein the members 300 are releasably attached to the at least one sidewall 100, and are adapted to hold, by way of example and not limitation, such items as hair clips C. The plurality of internal attachment members 300 may vary in shape and size to accommodate varying sizes and configurations of hair clips C.

Figure 3:
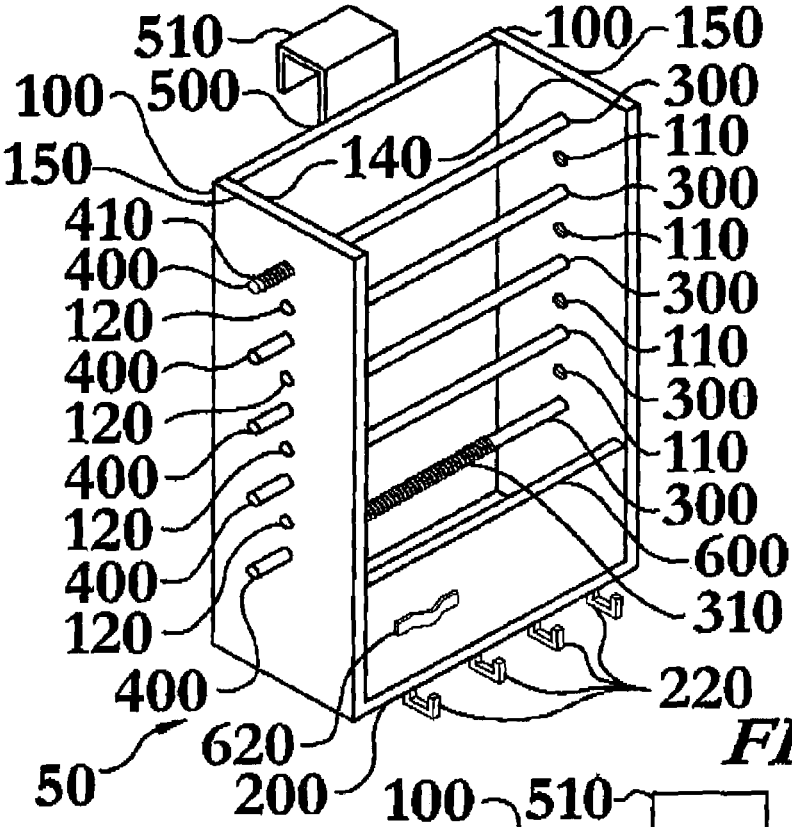
FIG. 3 shows a variation in the accessory holding device in elevated perspective view, in reduced scale.
Figure 4:
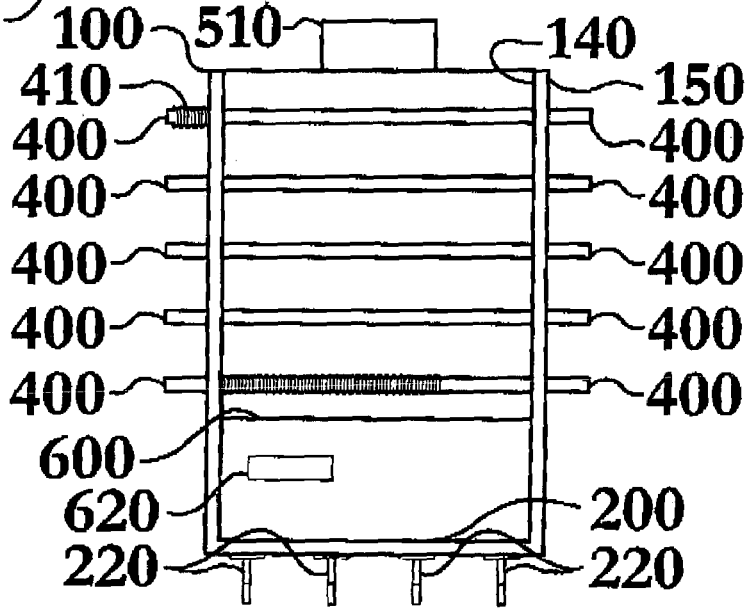
FIG. 4 shows a variation in the accessory holding device of FIG. 3 in front elevation view, in reduced scale.

Numerous variations are possible on this theme. By way of example and not limitation, as seen in FIGS. 3 and 4, at least one of the plurality of internal attachment members 300 may have a grip enhancing surface 310. The grip enhancing surface 310 may include a variety of surface texture variations on the plurality of internal attachment members 300, or they may be externally applied. Common externally applied grip enhancing surfaces 310 may include corrugated plastic and rubber coatings that may additionally include antimicrobial characteristics. In the case of corrugated coatings, the corrugations may be sized to cooperate with the teeth spacing of common hair clips C.

Additionally, there may be at least one suspension device 220 attached to the base plate 200. The suspension devices 220 may be as simple as common hooks in some variations, yet may incorporate cushioned cleat type devices for use with particular articles of jewelry.

Further, the at least one sidewall 100 may have a plurality of sidewall recesses 110 in the inner surface 140 of the at least one sidewall 100 that are formed to receive the plurality of internal attachment members 300. The plurality of sidewall recesses 110 may simply be smooth recesses sized and configured to cooperate with the plurality of attachment members 300, or they may be fitted with a number of mechanical joining means. For instance, one embodiment may include sidewall recesses 110 that are internally threaded to mate with corresponding threads on the plurality of attachment members 300. Alternatively, the sidewall recesses 110 may include quick-turn mechanical lock fittings to securely retain the plurality of attachment members 300.

With further reference to FIGS. 3 and 4, the device 50 may have the at least one sidewall 100 configured with a plurality of attachment member receivers 120 that are formed to communicate between the at least one sidewall inner surface 140 and the at least one sidewall outer surface 150, and further formed to releasably receive the plurality of internal attachment members 300. One skilled in the art will realize that such a plurality of attachment member receivers 120 will allow great flexibility in the possible arrangement of the internal attachment members 300 within the device 50.

Figure 5:
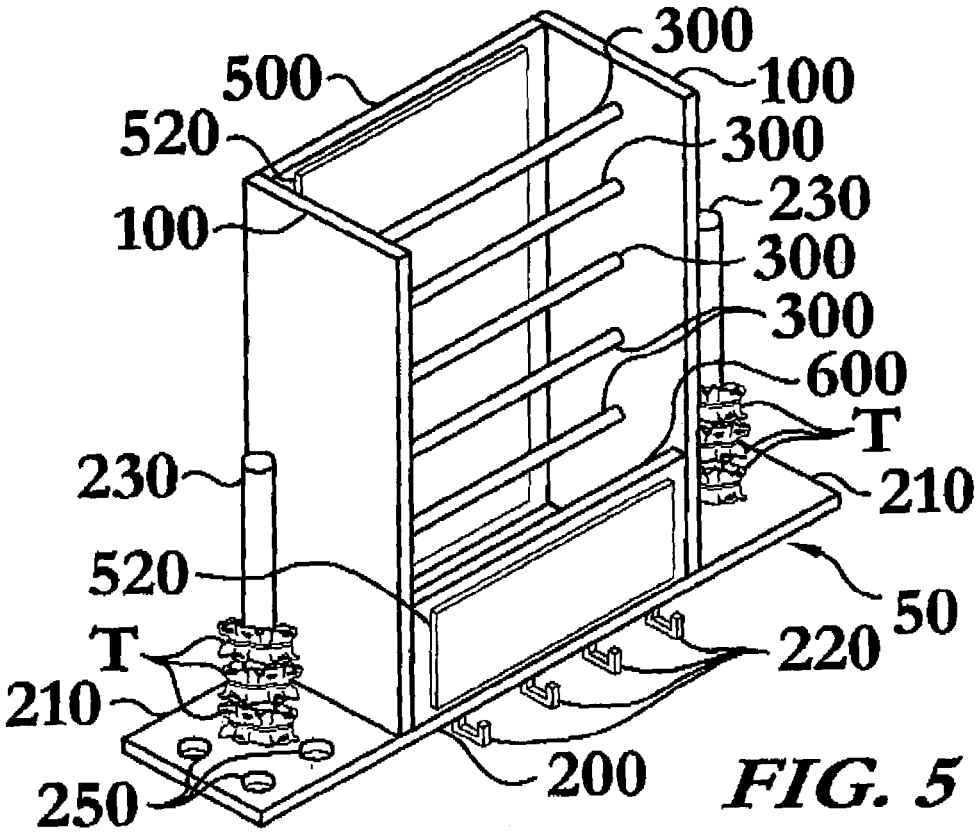
FIG. 5 shows a variation in the accessory holding device in elevated perspective view, in reduced scale.
Figure 6:
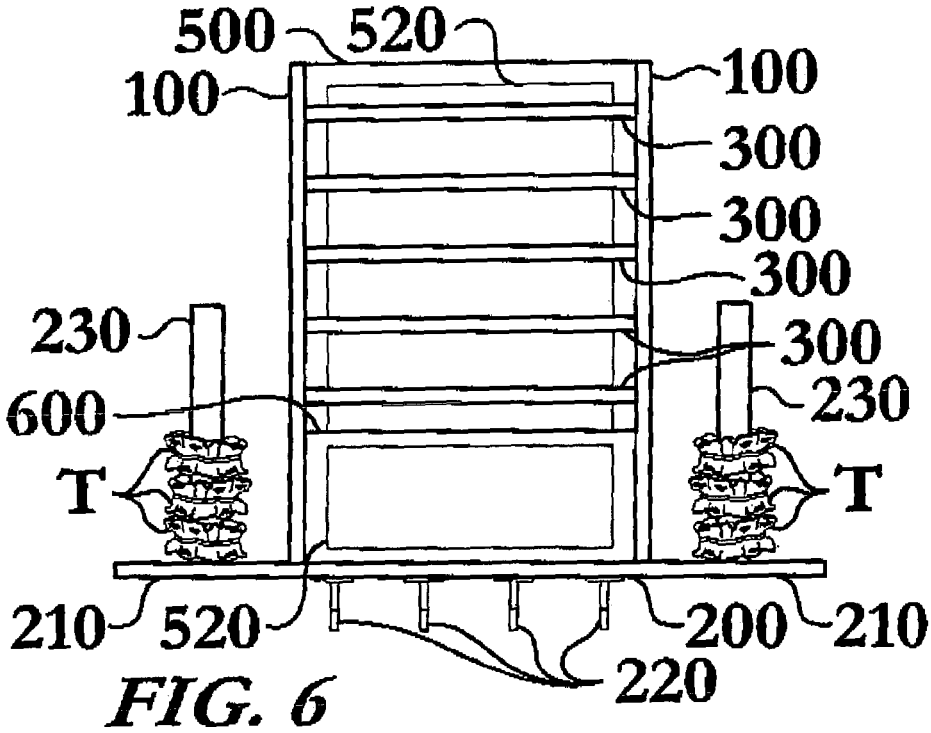
FIG. 6 shows a variation in the accessory holding device of FIG. 5, in front elevation view, in reduced scale.
Figure 7:
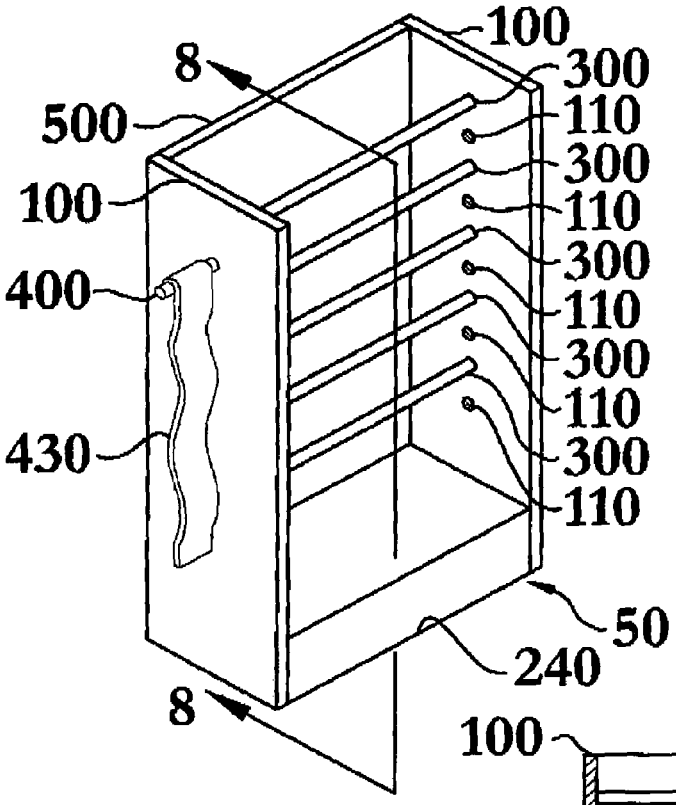
FIG. 7 shows a variation in the accessory holding device, in elevated perspective view, in reduced scale.
Figure 8:
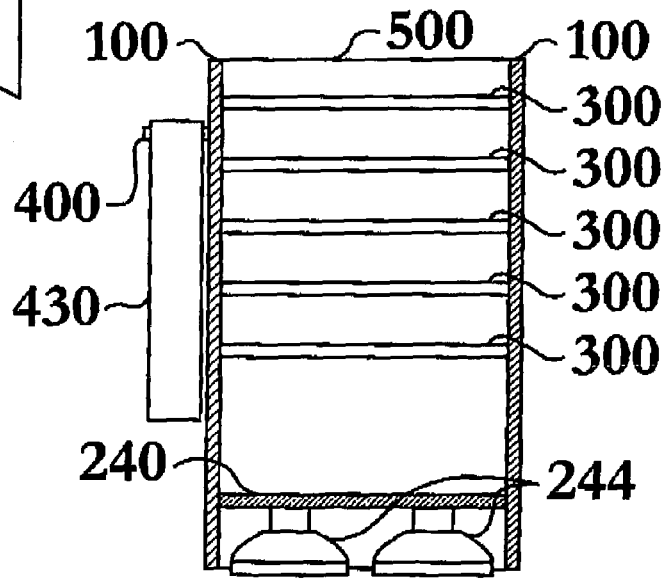
FIG. 8 shows a variation in the accessory holding device of FIG. 7 in front elevation view, in reduced scale.

Utility is not confined to the internal aspects of the device 50, as it is easily possible to configure the device 50 with a wide variety of external attachments, as seen in FIGS. 3 through 9. The at least one sidewall 100 outer surface 150 may have at least one auxiliary sidewall recess 130 formed to releasably receive at least one external attachment member 400, as seen in FIGS. 3, 4, and 7. Further, the at least one external attachment member 400 may have a grip enhancing surface 410 similar to that previously described in relation to the plurality of internal attachment members 300. The at least one external attachment member 400 may be formed, by way of example and limitation, as an accessory retainer 420, seen in FIG. 9, formed to hold such items, by way of example and not limitation, necklaces N and bracelets B. There may be a flexible attachment member 430 suspended from the at least one external attachment member 400, as seen in FIGS. 7 and 8. Such a flexible attachment member 430 facilitates the attachment and retention of various pinned or clipped articles, such as, by way of example and not limitation, earrings and pins. As one with skill in the art can appreciate, the at least one external attachment member 400 may be integral with one of the plurality of internal attachment members 300.

Directing attention now to FIG. 5, the base plate 200 may have at least one auxiliary base plate recess 250, fanned to releasably receive at least one base plate post 230 and, there may be at least one base plate extension 210 extending laterally beyond the point wherein the base plate 200 intersects the at least one sidewall 100. The base plate extension 210 may have at least one auxiliary base plate recess 250, as seen in FIG. 5, formed to releasably receive at least one base plate post 230. Such posts 230 are formed to bold a plurality of accessories, such as, by way of example and not limitation, annular elastic hair ties T. Storing various elastic devices on the post 230 haste advantage of not storing these elastic devices in a stretched position, and therefore such storage does not contribute to eventual elastic fatigue of the accessory.

Figure 9:
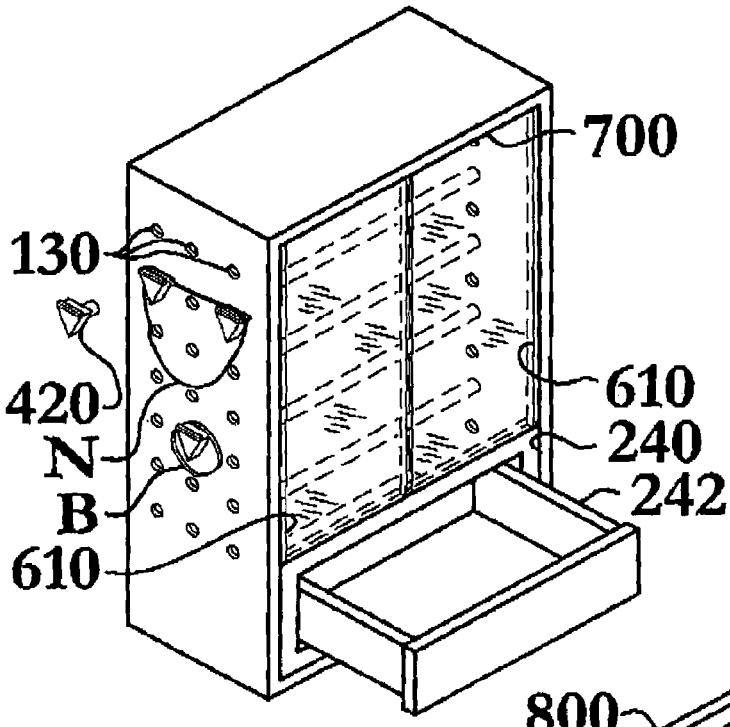
FIG. 9 shows a variation in the accessory holding device, in elevated perspective view, in reduced scale.

In yet another embodiment, seen in FIG. 9, the base plate 200 may be formed as a base box 240. The base box 240 may contain at least one suction grip 244, seen in FIG. 8, to give the device 50 more secure attachment to a plurality of surfaces, as may be desired when locating the device 50 on a countertop or the top surface of the tank of a water closet. To facilitate the storage of various items, in another embodiment, as seen in FIG. 9, the base box 240 may further include at least one drawer 242.

In an additional embodiment, seen in FIGS. 3 through 10, the device may further include a back plate 500, connected to at least one of the at least one sidewalls 100. There may be a mounting device 510, seen in FIGS. 3 and 4, attached to at least a portion of the back plate 500. The mounting device 510 may be formed in an over the door type configuration shown in FIG. 3, or may be formed to secure to towel racks and hangers, or simple mechanical fasteners secured to a wall.

Further, the back plate 500 may further include a mirror 520, seen in FIGS. 5 and 6, on at least a portion of the back plate 500. Similarly functioning to the auxiliary base plate recess 250 described above, the back plate 500 may include at least one auxiliary back plate recess 530, seen in FIG. 10, formed to releasably receive at least one back plate post 540.

Various embodiments enclose the device 50 further, as seen in FIGS. 3 through 6 and 9. The device 50 may include a top plate 700, connected to at least one of the at least one sidewalls 100, as seen in FIG. 9. Additionally, there may be a face plate 600, seen in FIGS. 3 through 6, connected to at least one of the at least one sidewalls 100. Further, there may be a mirror 520 on at least a portion of the face plate 600, as seen in FIGS. 5 and 6, and there may be at least one auxiliary retainer 620 attached to the face plate 600, seen in FIGS. 3 and 4, formed to releasably retain a plurality of accessories. The at least one auxiliary retainer 620 may be formed as an elastic member designed to stretch and retain items such as brushes and combs.

Figure 10:
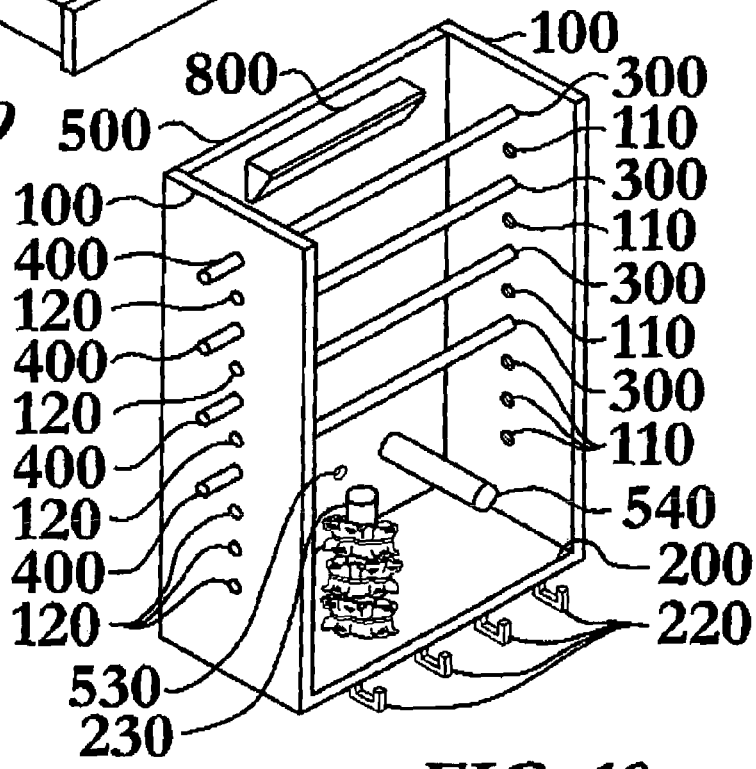
FIG. 10 shows a variation in the accessory holding device of FIG. 10, in elevated perspective view, in reduced scale.

As seen in FIG. 9, the device 50 may be further enclosed by employing at least one door 610, rotably attached to at least one of the at least one sidewalls 100. To enhance the user's ability to locate items within the device 50, the device 50 may be fitted with an interior light 800, as seen in FIG. 10.

The device 50 may be crafted of a wide variety of materials, including but not limited to wood, metal, plastics and various composites thereof. While for illustrative purposes, the device 50 is shown illustrated with rectangular sidewalls 100, base plates 200, back plates 500, face plates 600 and top plates 700, such members may be crafted in a wide variety of aesthetically pleasing shapes, and may bear artistic or informative indicia.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

I claim:

1. An accessory holding device, comprising:

at least one sidewall having an inner surface and an outer surface, and a base plate, wherein the base plate is attached to the at least one sidewall, has at least one auxiliary base plate recess, formed to releasably receive at least one base plate post, and at least one base plate extension extending laterally beyond the point wherein the base plate is attached to the at least one sidewall;

a plurality of internal attachment members, wherein the members are releasably attached to the at least one sidewall; and at least one base plate post formed to be releasably received by the at least one auxiliary base plate recess such that the at least one base plate post extends in an upward direction away from the base plate such that annular accessories may be stored in an organized manner on the at least one base plate post.

2. The device of claim 1, further including at least one suspension device attached to the base plate.

3. The device of claim 1, wherein the at least one sidewall has a plurality of sidewall recesses in the inner surface of the at least one sidewall, formed to receive the plurality of internal attachment members.

4. The device of claim 1, wherein the base plate extension has at least one auxiliary base plate recess, formed to releasably receive at least one base plate post.

5. The device of claim 1, further including a back plate, connected to at least one of the at least one sidewalls.

6. The device of claim 5, further including a mirror on at least a portion of the back plate.

7. The device of claim 1, further including a face plate, connected to at least one of the at least one sidewalls.

8. The device of claim 7, further including a mirror on at least a portion of the face plate.

* * * * *